US006340802B1

(12) United States Patent
Bascom et al.

(10) Patent No.: US 6,340,802 B1
(45) **Date of Patent: *Jan. 22, 2002**

(54) LOCKOUT MECHANISM FOR POWER TOOL

(75) Inventors: James P. Bascom, Bel Air; John E. Buck, Cockeysville, both of MD (US)

(73) Assignee: Black & Decker, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/524,867

(22) Filed: Mar. 14, 2000

Related U.S. Application Data

(63) Continuation of application No. 09/133,846, filed on Aug. 14, 1998, now Pat. No. 6,057,518.

(51) Int. Cl.[7] ..... H01H 9/28

(52) U.S. Cl. ..... 200/43.17; 200/43.16; 200/321; 200/322

(58) Field of Search ..... 30/200, 216, 228, 30/381, 382; 192/131 R; 200/43.16–43.21, 61.85, 522, 293.1, 318, 318.1, 321, 322, 332.2; 310/47, 50

(56) References Cited

U.S. PATENT DOCUMENTS

| | | | | |
|---|---|---|---|---|
| 1,929,662 | A | 10/1933 | Wappat | |
| 3,331,406 | A | 7/1967 | Christophel | |
| 3,376,402 | A | 4/1968 | Bednarski | |
| 3,383,943 | A | 5/1968 | Piber | |
| 3,422,296 | A | 1/1969 | Frank | 310/68 |
| 3,461,556 | A | 8/1969 | Chambers | |
| 3,579,002 | A | 5/1971 | Wickham | 310/50 |
| 3,626,118 | A | 12/1971 | Botefuhr | |
| 3,746,815 | A | 7/1973 | Drummer | 200/157 |
| 3,780,246 | A | 12/1973 | Beckering et al. | |
| 3,873,796 | A | 3/1975 | Worobee, Jr. | |
| 3,922,785 | A | 12/1975 | Fushiya | |

(List continued on next page.)

FOREIGN PATENT DOCUMENTS

| | | | |
|---|---|---|---|
| DE | 73 21 450 | 9/1973 | H01H/3/50 |
| DE | 22 54 554 B2 | 5/1974 | H01H/3/20 |
| DE | 30 07 304 C2 | 9/1981 | H01H/3/20 |
| DE | 31 04 733 C3 | 8/1982 | H01H/9/20 |
| DE | 3731079 A1 | 3/1989 | H02K/22/66 |
| DE | 89 08 924 | 10/1989 | H01H/3/20 |
| DE | 40 12 697 C2 | 10/1990 | H01H/3/20 |
| DE | 40 23 101 C2 | 1/1992 | F16P/3/00 |
| DE | 43 09 033 A1 | 9/1994 | H01H/9/20 |
| DE | 196 44 285 A1 | 4/1997 | H01H/3/20 |
| DE | 197 07 215 A1 | 9/1997 | H01H/3/20 |
| DE | 197 45 100 A1 | 4/1998 | H01H/9/20 |
| EP | 777 244 A2 | 6/1997 | H01H/3/20 |
| FR | 2 338 115 | 8/1977 | B26D/4/28 |

OTHER PUBLICATIONS

XS09930621110 MA, Date Unknown, Abstract–Switzerland.

*Primary Examiner*—Michael Friedhofer
(74) *Attorney, Agent, or Firm*—Shook, Hardy & Bacon LLP

(57) ABSTRACT

A power tool includes a hollow housing defining a handle with an external wall. A motor is disposed in the housing. A switch is pivotally mounted in the handle about a first axis for actuating the motor. The switch has a first locking abutment. A latch is located adjacent the switch and is pivotally mounted in the handle about a second axis generally parallel to the first axis for movement back and forth between an engaged and a disengaged position. The latch has a second abutment for engaging the first abutment and preventing the switch from being actuated. The latch when pivoted to engage the first and second abutments applies a force vector generally intersecting the second axis.

14 Claims, 2 Drawing Sheets

U.S. PATENT DOCUMENTS

| | | | | |
|---|---|---|---|---|
| 3,952,239 | A | | 4/1976 | Owings et al. |
| 3,971,906 | A | | 7/1976 | Sahrbacker |
| 3,973,179 | A | | 8/1976 | Weber et al. |
| 4,122,320 | A | | 10/1978 | Edgell et al. |
| 4,135,068 | A | | 1/1979 | Burns ..... 200/61.85 |
| 4,180,716 | A | | 12/1979 | Suzuki ..... 200/320 |
| RE30,270 | E | | 5/1980 | Piber |
| 4,276,459 | A | | 6/1981 | Willett et al. |
| 4,277,666 | A | | 7/1981 | Vignaud ..... 200/328 |
| 4,588,910 | A | | 5/1986 | Bausch ..... 310/50 |
| 4,864,083 | A | | 9/1989 | Bittel ..... 200/1 V |
| 4,900,881 | A | | 2/1990 | Fisher ..... 200/61.85 |
| 4,934,494 | A | | 6/1990 | Fushiya et al. |
| 5,005,295 | A | | 4/1991 | Fushiya |
| 5,094,000 | A | | 3/1992 | Becht et al. |
| 5,233,945 | A | | 8/1993 | Wolf et al. ..... 123/41.7 |
| 5,310,259 | A | | 5/1994 | Wanat ..... 366/349 |
| 5,440,089 | A | | 8/1995 | Prokop ..... 200/321 |
| 5,483,727 | A | | 1/1996 | Chang |
| 5,570,512 | A | | 11/1996 | Hoppner |
| 5,570,776 | A | | 11/1996 | Buchholz et al. |
| 5,577,600 | A | | 11/1996 | Schoene et al. |
| 5,638,945 | A | | 6/1997 | Fukinuki et al. |
| 5,681,214 | A | | 10/1997 | Kleider et al. ..... 451/358 |
| 5,778,747 | A | | 7/1998 | Chen ..... 83/471.3 |
| 5,969,312 | A | | 10/1999 | Svetlik et al. ..... 200/61.85 |
| 6,057,518 | A | * | 5/2000 | Bascom et al. ..... 200/43.17 |
| 6,091,035 | A | * | 7/2000 | Campbell et al. ..... 200/321 |

* cited by examiner

LOCKOUT MECHANISM FOR POWER TOOL

CROSS REFERENCE TO RELATED APPLICATIONS

The present application is a continuation of application Ser. No. 09/133,846, filed Aug. 14, 1998, now U.S. Pat. No. 6,057,518.

STATEMENT REGARDING FEDERALLY-SPONSORED RESEARCH OR DEVELOPMENT

Not applicable.

FIELD OF THE INVENTION

This invention relates to a switch lockout mechanism for a power tool, and, more particularly, to a mechanism that locks the power switch in an "off" position and requires an operator to actuate a separate lever to orient the switch to its "on" position.

BACKGROUND OF THE INVENTION

Power tools, such as circular saws, typically have a handle molded into the body of the tool. Such a handle is grasped by the power tool operator to guide and propel the tool through the workpiece. Usually, in a circular saw, there is a rear handle and a forward handle. The rear handle oftentimes resembles a pistol grip, and extends upwardly and forwardly. The handle is separated from the body of the saw so that the operator can easily grasp an elongated handle section that fits comfortably within the hand of the operator. This handle section typically extends in a direction that is generally parallel to and along the line of travel of the saw. As is apparent, it is extremely desirable to have the on/off switch for the saw located where it can be actuated by at least the index finger of the operator's hand engaging the handle. Such an arrangement allows an operator to selectively start and stop the cutting operation of the saw while having his/her hand gripping the handle.

Many prior power tool constructions have a lockout mechanism also associated with the handle structure which holds the switch on the handle in a locked position and requires the operator to actuate the mechanism prior to turning the power tool to the "on" position utilizing the switch. In particular, many of these prior structures require an operator to actuate a separate button or lever with his/her thumb prior to or simultaneously with actuation of the switch by the index finger of the operator's hand gripping the handle.

Prior lockout mechanisms or latches typically are of two main types, a pivoting type and a sliding type. In a pivot-type arrangement the latch is pivotally mounted within the handle structure about an axis which is transverse or perpendicular to the elongated direction of the handle. In the case of a circular saw, the latch is pivotally mounted about an axis that is parallel to the axis of rotation of the saw blade. These latches operate by pivoting between an engaged position wherein the handle switch contacts the latch member and is prevented from movement to its "on" position, and a disengaged position wherein the operator is allowed to actuate the switch to the "on" position. Examples of these transverse pivotal lockout mechanisms can be found in U.S. Pat. Nos. 3,873,796 and 5,577,600. In each of these references, the latch mechanism is actuated by a button located on the top surface of the handle. In particular, they require either the pushing of the button or the rotating of the button rearwardly to allow actuation of the switch. These structures are disadvantageous for various reasons. In particular, the location of the lockout mechanism button on the top surface of the handle requires the positioning of the thumb in an awkward position. More specifically, it is natural when gripping a handle for the thumb to be along the side of the handle with the cross section of the handle received between the thumb and index finger. As is apparent, to actuate the mechanisms in these references, the thumb must first be positioned on the top of the handle, thus resulting in a less secure grip on the handle. Such loose gripping can result in misalignment of the saw during its initial cutting actions. Still further, in these prior references, for the thumb to reach the normal gripping position on the side of the handle, the thumb must slide off the button and over the side of the handle. The friction associated with the thumb passing over the top surface of the handle and the awkward sideward movement of the thumb can result in operator discomfort during the initial cutting action of the saw.

A still further disadvantage of these references is the location of the lockout mechanism at the same general location of or behind the location of the on/off switch with respect to the longitudinal axis of the handle. More specifically, when a person typically grabs a handle, the tendency is for the thumb to be forward of the index and middle fingers. To actuate the lockout mechanism buttons of these references, the thumb must be moved rearwardly to push the actuating button, thus presenting a potential awkward position for the saw operator, and, further, possibly resulting in unnecessary reorientation of the thumb along the side of the handle to the normal gripping position.

These references suffer from a further disadvantage in that they do not provide a "trigger" feel or structure for saw operation. More specifically, in each of these references, the trigger mechanism is pivotally mounted at a location far down the handle from the normal positioning of the index finger of the operator. The pivoting arc of such structures is relatively great and results in the trigger lever or button extending a fair distance longitudinally within the handle structure. As is apparent, to have a true "trigger" type feel to an actuating switch, and to decrease the space necessary for the switch, it may be desirable to have the pivot point for the switch located at a location adjacent the index finger of the operator's hand as it grips the handle. Thus, the rotation of a switch is truly of a "trigger" nature if the pivot point is located adjacent the top of the switch and the lower end of the switch rotates inwardly toward the handle. The large trigger structures of the above references also may result in some instability and finger fatigue in operating the structure. More specifically, because the trigger structure is not confined by a guard but extends along the length of the handle, it may be difficult for an operator to align his or her fingers with the trigger for actuation thereof.

The second type of lockout mechanism includes a latch member which, when actuated, slides within the handle housing to allow actuation of the on/off switch by the operator. An example of this type of sliding latch member is disclosed in U.S. Pat. No. 5,638,945. These sliding lockout mechanisms are oftentimes relatively complicated and do not allow ergonomic positioning of the thumb during the beginning power tool operation. More specifically, the lockout structure of the above patent, again, has the actuating button positioned on the top surface of a handle housing and at a location that is above the actuating switch for the power tool. Thus, an operator, to use the power tool, is required to position his or her thumb on the top of the handle instead of along the side, and to push the lockout mechanism button forward on the upper surface while pushing upward on the switch, and thereafter to slide the thumb of the hand positioned on the handle to the side of the handle to the normal comfortable gripping position. As with the pivoting latch mechanisms discussed above, this sliding-type mechanism is highly disadvantageous because it requires the operator to utilize significant effort to reposition his or her thumb in a normal gripping operation, and also has the sliding actuating switch or button located generally at the same location as the on/off switch along a longitudinal axis of the handle which is typically not a normal position for a user's thumb of the hand gripping the handle. An additional disadvantage of sliding mechanisms is that they are oftentimes subject to contamination by dirt or grease, which affects their operations. In particular, sliding mechanisms often have grooves and sliding surfaces which can become fouled easily.

Prior art lockout mechanisms are also oftentimes subject to substantial forces as an operator attempts to actuate the power switch with the lockout mechanism in its locked position. Sometimes, such prior art mechanisms will give way and actually allow actuation of the power switch, without the operator first utilizing the button or other structure to disengage the lockout mechanism.

Therefore, a lockout mechanism is needed which will overcome the problems with the prior art lockout mechanisms discussed above.

SUMMARY OF THE INVENTION

An object of the present invention is to provide a lockout mechanism for a power tool wherein the force vector of the switch of the lockout mechanism is aligned at a predetermined location to help prevent inadvertent bypassing of the lockout mechanism by strong pressure on the switch.

A further object of the present invention is to provide a lockout mechanism for a power tool, wherein the actuating lever of the lockout mechanism is positioned at a location that is ergonomically advantageous for the operator and that allows easy transition from actuation of the lockout mechanism to the normal gripping operation of the power tool.

A still further object of the present invention is to provide a lockout mechanism for a power tool wherein the lockout mechanism pivots in the rotational direction of the normal thumb action of the user.

A still further object of the present invention is to provide a lockout mechanism with an actuating lever which is oriented such that the thumb can be moved easily downward over the surface of the actuating lever to its normal gripping position.

A still further aspect of the present invention is to provide a lockout mechanism that can accommodate a "trigger" type power switch which is pivotally mounted forwardly on the handle.

Yet another object of the present invention is to provide a lockout mechanism that is resistant to contamination and fouling.

Accordingly, the present invention provides for a power tool, including a hollow housing defining a handle with an external wall. A motor is disposed in the housing, and a switch is pivotally mounted in the handle about a first axis for actuating the motor. The switch also has a first locking abutment. A latch is located adjacent the switch and is pivotally mounted in the handle about a second axis generally parallel to the first axis for movement back and forth between an engaged and a disengaged position. The latch has a second abutment for engaging the first abutment and preventing the switch from being actuated. The switch when pivoted to engage the first and second abutments applies a force vector generally intersecting the second axis. The latch of the lockout mechanism is pivoted to a disengaged position in a rotational direction that is the same as the normal downward pivoting action of the user's thumb.

The present invention includes the structure as described above, wherein the latch is a generally L-shaped leg with first and second segments connected by a knee. The knee forms the pivot point to the latch. Such invention further includes an actuating lever extending transverse to the leg and disposed on the first segment. The first segment extends in a direction forward of the second axis.

The present invention also provides for the latch of the lockout mechanism to have a surface for engagement of the thumb of the user, with the surface sloping downwardly in the direction of the movement of the thumb of the user when moving the latch from an engaged to a disengaged position.

Additional objects, advantages and novel features of the invention will be set forth in part in a description which follows, and in part will become apparent to those skilled in the art upon examination of the following, or may be learned by practice of the invention.

BRIEF DESCRIPTION OF THE DRAWINGS

In the accompanying drawings which form a part of this specification and are to be read in conjunction therewith and in which like reference numerals are used to indicate like parts in the various views.

DETAILED DESCRIPTION OF THE PREFERRED EMBODIMENTS

Figure 1:
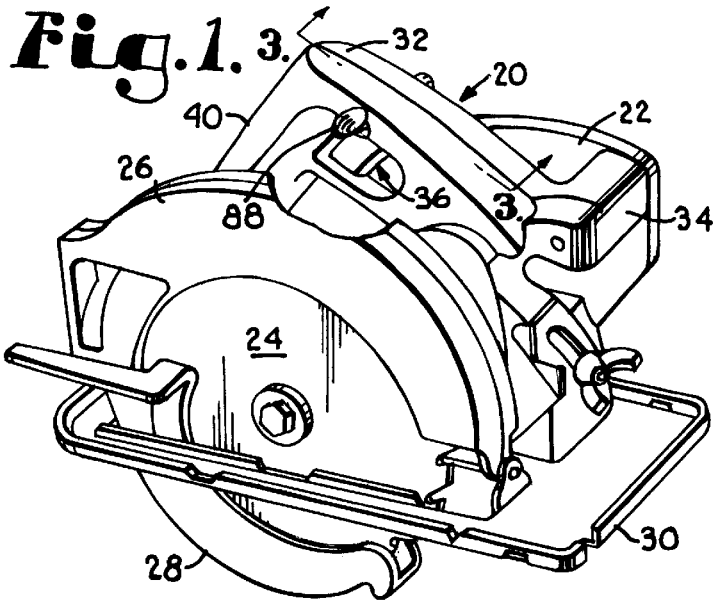
FIG. 1 is top perspective view of a circular saw having a lockout mechanism embodying the principles of the present invention.

Referring to the drawings in greater detail, and initially to FIG. 1, a power circular saw designated generally by the numeral 20 is shown. Saw 20 has a housing assembly 22 in which is disposed a motor for powering a blade 24. Blade 24 is generally surrounded by an upper stationary guard 26 and a lower movable guard 28. Saw 20 also has a generally planar base or shoe 30 attached to stationary guard 26. Base 30 rests on the upper surface of the workpiece as the saw passes therethrough and is used to gauge the depth to which blade 24 cuts.

Saw 20 further includes a rear trigger handle 32 and a forward brace handle 34. The trigger handle 32 has a power switch 36 mounted therein for operation by one hand of the saw user. The other hand of the saw user is positioned on brace handle 34 which allows the user to further control the saw as it passes through the workpiece.

Figure 2:
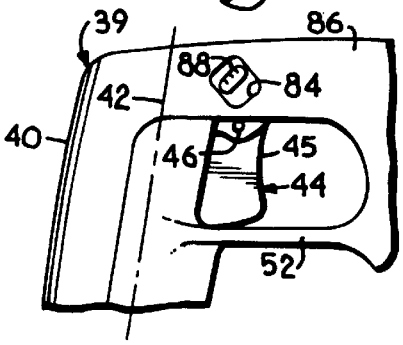
FIG. 2 is an enlarged, side elevational view of the lockout mechanism shown in FIG. 1, with the lockout mechanism in its "locked" position.

Trigger handle 32 has a generally hollow housing 38 which can be formed in a clamshell fashion by half sections 39. Housing 38 has a gripping portion 40 which fits within the palm of an operator during operation, and generally extends in an elongated direction along an axis 42, as best shown in FIG. 2. Power switch 36 is received within housing 38 and has a trigger 44 extending through an aperture 48 formed within housing 38 that allows actuation of the trigger by the index finger of an operator. More specifically, trigger 44 is configured with a finger-engaging surface 45 that accommodates the index finger of the hand of the operator gripping the handle. Trigger 44 is pivotally mounted about an axis 46 that is transverse to the elongated direction of handle portion 40 and to axis 42. Trigger 44 is actuated by an operator utilizing his or her index finger to rotate trigger 44 to the left in FIG. 5. As this is done, electrical contacts are made within switch 36 to connect the power supply of the saw with the saw motor to result in rotation of the blade. Trigger 44 is biased to its "off" position such that to actuate the switch and rotate it about axis 46 an operator must overcome the internal bias within switch 36. Trigger 44 can be pivotally mounted within housing 38 by a pin, trunnion or other suitable pivotal mounting arrangement.

Trigger 44 is also received in a finger resting ring 52 extending outwardly from handle portion 40 and generally perpendicular to axis 42. Ring 52 serves to orient the index finger of a saw operator on trigger 44, and also provides a resting surface 54 upon which the index finger of a saw user can rest during operation while at the same time actuating the trigger. Ring 52 will help prevent an operator's index finger from slipping off of trigger 44 during operation because of the containment of the index finger within the aperture formed by the ring. Thus, the upper pivotal nature of trigger 44 and the positioning of the trigger within a finger support ring 52 provides a true "trigger" type operation which users often find comfortable and advantageous in selectively controlling the saw.

Figure 4:
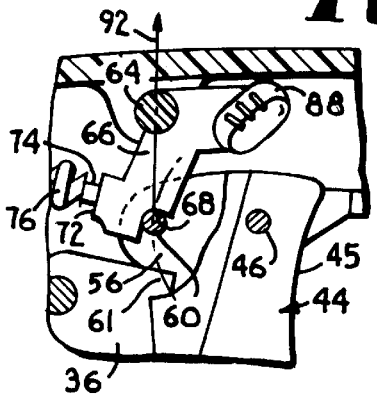
FIG. 4 is a further enlarged view similar to FIG. 3 showing the latch of the lockout mechanism, and further showing the force vector associated with the switch of the saw, and the arc rotation of a lockout pin of the switch.
Figure 5:
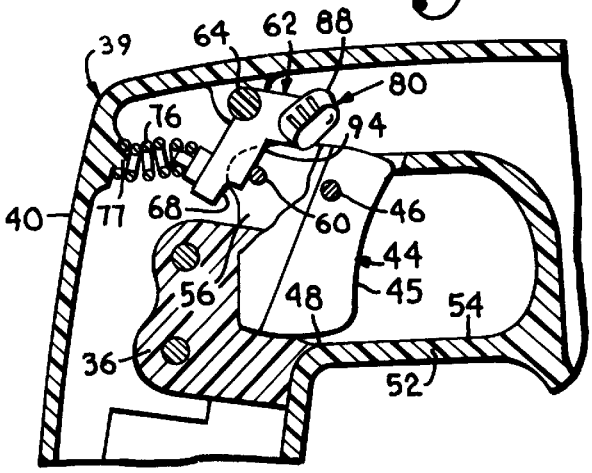
FIG. 5 is a view similar to FIG. 3 but showing the latch mechanism in its "unlocked" position and the trigger switch actuated to the "on" position of the saw.
Figure 6:
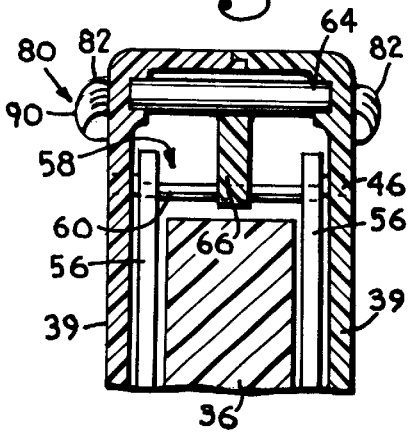
FIG. 6 is a cross-sectional view taken generally along line 6—6 of FIG. 3.

Trigger 44 generally includes opposed spaced parallel sidewalls or flanges 56 which form a latch receiving space 58 therebetween, as best shown in FIGS. 4–6. Trigger 44 has a locking pin 60 extending between flanges 56 at a location within housing 38 that is on the opposite side of trigger 44 from finger-engaging surface 45. Pin 60 rotates in the arc 61 indicated in FIG. 4 when trigger 44 is rotated. Pin 60 provides a locking engagement surface or abutment for engaging latch 62, as will be more fully described below.

Figure 3:
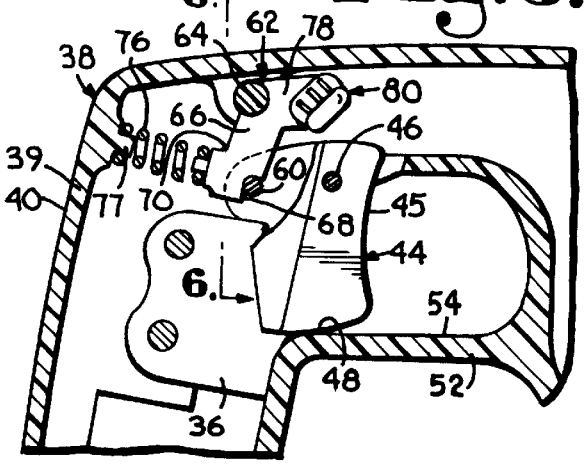
FIG. 3 is a cross-sectional view taken generally along lines 3—3 of FIG. 1 and showing the lockout mechanism in its "locked" position, parts broken away and shown in cross section to reveal details of construction.

Latch 62 is generally L-shaped in nature and is pivotally mounted within housing 38 about an axis or pivot point 64 which is generally transverse to the elongated direction of handle portion 40 and axis 42. Latch 62 is pivotally mounted within housing 38 by any suitable means, such as a pivot pin, trunnion or other pivoting arrangement. Extending from axis 64 in a generally rearward direction is a locking leg or segment 66. Disposed on a rearward end of locking leg 66 is a generally arcuate abutment surface or cutout 68. Cutout 68 is used to engage pin 60 to secure trigger 44 in its locked position, as will be more filly described below. Leg 66 can have an inverted channel shape to reduce the weight associated with the latch member. Positioned on an upper surface 70 of locking arm 66 is a spring receiving area 72 and a spring maintaining pin 74. As best shown in FIGS. 3 and 4, a coil compression spring is positioned about pin 74 and on area 72 and extends from arm 66 to a suitable receiving area 77 on an upper surface of housing 38. Spring 76 is used to bias latch 62 toward a locked position, as will be more fully described below.

Figure 7:
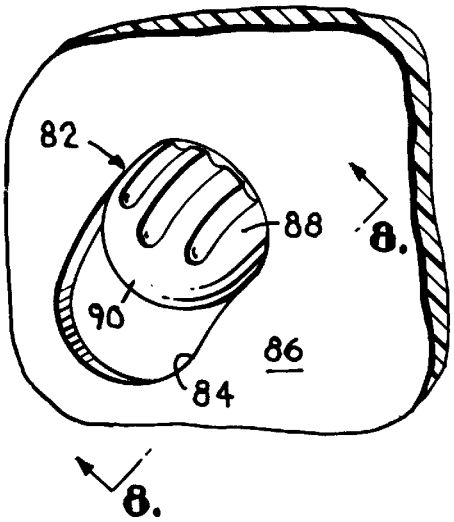
FIG. 7 is a top perspective view of a lockout mechanism actuating lever extending from one side of a handle.
Figure 8:
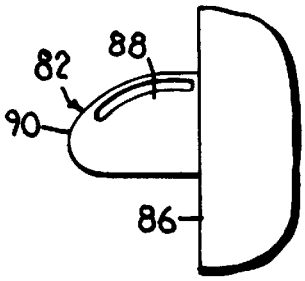
FIG. 8 is a sectional view taken generally along line 8—8 of FIG. 7 and showing a side profile of the actuating lever.

Extending forwardly from pivot axis 64 is an actuating leg or segment 78. Leg 78 extends within housing 38 to a position that is forwardly of pivot axis 46 of trigger 44 along the elongated direction of portion 40. Located on a forward end of leg 78 is a locking lever 80 that extends transversely to the elongated direction of handle portion 40. In particular, lever 80 has two operator engaging sections 82 extending in opposite directions through oppositely disposed apertures 84 formed on the side walls 86 of housing 38. Segments 82 are the areas that are engaged by an operator to rotate latch 62 between a locked position, and an unlocked position, as will be more fully described below. Each segment 82 of lever 80 has an upper surface 88 that is sloped downwardly in a direction from the front of the saw toward the back of the saw, as best shown in FIG. 3. Still further, surface 88 is curved in a downwardly sloping arcuate fashion away from side wall 86 to a lever end 90 (as best shown in FIGS. 6–8). This arcuate curving is in a convex upwardly fashion. It is surface 88 and this downwardly sloping arcuate orientation from sidewall 86 to end 90 that allows a user to easily slide his or her thumb off of the segment 82 after latch 62 has been actuated to its disengaged position and to position the thumb at a more comfortable location along the side of handle housing 38. In particular, as segment 82 is actuated downwardly by the thumb of a user, it is desirable for the thumb to stay as close to side wall 86 as possible. The sloping nature of segment 82 from side wall 86 to end 90 allows the thumb to slide over end surface 90 and resume its normal gripping position. End 90 is such that it is similar to a partial spherical surface which also aids the slide of the thumb off of segment 82. The thumb of the user may move slightly outwardly away from side wall 86 as the thumb slides over end 90. However, the slope of surface 88, the distance segment 82 extends beyond surface 86, and the soft tissue associated with a user's thumb tip may be such that there is no noticeable outward movement of the thumb from side wall 86. In addition, some users may find it desirable to continue to rest their thumb on surface 88 during the entire cutting operation. The sloped surface 88 and its elimination of any sort of sharp edge associated with end 90 allows more user comfort if the user keeps his/her thumb on the segment.

With reference to FIGS. 3 and 4, latch 62 is generally shown in a "locked" or "engaged" position. In this position, cutout 68 engages pin 60 of trigger 44, and is maintained thereon by the bias in coil spring 76. If a user attempts to rotate trigger 44 about trigger axis 46, latch 62 will prevent such rotation due to the engagement of abutting pin 60 and abutment cutout 68. An advantageous feature of latch 62 is the orientation such that the force vector of a user attempting to rotate trigger 44 at pin 60 extends directly through latch pivot axis 64. More specifically, the rotational arc of trigger 44 at pin 60 is shown in FIG. 4, as reference numeral 61. As a user attempts to rotate trigger 44 with his or her index finger, the force vector applied by such action will be generally tangential to such a radius of rotation. The force vector applied by rotation is generally indicated by the reference numeral 92 in FIG. 4. Pivot axis 64 of latch 62 is configured such that force vector 92 resulting from attempted actuation of trigger 44 extends directly through axis 64. Therefore, there are no force components being applied to latch 62 other than those directly through axis 64. As is apparent, this structure, because there are no other force vectors, helps prevent accidental disengagement of latch 62 and holds it firmly in its locked position even if substantial pressures are applied to trigger 44 by an operator.

With reference to FIG. 5, latch 62 is rotated to an "unlocked" and "disengaged" position by an operator pushing downwardly on upper surface 88 of either segment 82 to rotate leg 66 generally upwardly so that cutout 68 disengages pin 60. As is apparent, this rotation results in compression of spring 76, thus applying a downwardly biasing force to arm 66 that must be overcome by additional pressure on surface 88. Subsequent to or simultaneously with pushing downwardly on surface 88, a user begins rotation of trigger 44 using his or her index finger. As trigger 44 is rotated, pin 60 can pass adjacent a lower edge 94 of an 60 until such time as electrical contact is made in switch 36 and the motor of saw 20 is actuated. As best shown in FIGS. 6–8, the downwardly sloping arcuate surface 88 from side wall 86 to end 90 allows an operator to easily slide his or her thumb over end 90 after latch 62 has been disengaged and thereafter rest comfortably along the side of housing 88 for further operation of the saw. The downward rotational direction of actuating leg 78 coincides with the downward pivot of a thumb, thus making the pivoting action of latch 62 a more natural occurrence for an operator.

After an operator releases from either surfaces 88, spring 76 will maintain contact between pin 60 and lower edge 94. After an operator is done cutting he or she simply releases trigger 44 and it returns to its "off" position via an internal spring bias. As it reaches its off position, pin 60 will again engage cutout 68 due to the bias of spring 76, and latch 62 will return automatically to its locked position. In order to reactuate trigger 44, an operator must again pivot latch 62 utilizing either of segments 82.

The lockout mechanism in the present invention is advantageous for a number of reasons. First of all, the orientation of pivot point 64 of latch 62 such that force vector 92 of trigger 44 extends through such latch axis helps ensure that the latch will not accidentally disengage even when subjected to substantial force.

Still further, the location of actuating segments 82 and their sloped engaging surfaces 88 at a location that is forwardly of the location of the front portion of engaging surface 75 of trigger 44 ensures that the normal hand orientation, wherein the thumb is typically forward of the index finger during a gripping action, can be attained during the initial cutting operations of the saw, thus preventing unstable and awkward initial cutting operations. The rotational direction of latch 62 to its unlocked position in the same direction as the downward pivot of a user's thumb further allows easy, comfortable efficient operation by a user.

Additionally, the downwardly sloping arcuate upper surfaces 88 from side walls 86 toward ends 90 allow an operator to easily slide the thumb of the gripping hand over end 90 and off of lever 80 once the latch has been actuated. The dual oppositely extending segments 82 on both sides of the housing also allow easy uniform operation by either right-handed or left-handed operators.

Still further, the pivoting actions of both trigger 44 and latch 62 reduce the vulnerability to contamination and increased friction that is oftentimes present when sliding lockout mechanisms are utilized.

From the foregoing, it will be seen that this invention is one well-adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matters herein set forth or shown in the accompanying drawings are to be interpreted as illustrative and not in a limiting sense.

We claim:

1. A power tool comprising:

a housing including an elongated handle having first and second ends, the handle having an internal cavity and opposed top and bottom walls and opposed side walls for receiving a hand of a user with a palm on the top wall, a thumb and index finger of the user adjacent the first end of the handle, and a pinkie of the user adjacent the second end of the handle, and an opening formed in at least on the side walls;

a motor in the housing;

a switch mounted in the handle cavity for actuating the motor;

a latch controlling actuation of the switch, mounted in the handle cavity adjacent the switch and movable between an engaged position engaging the switch and a disengaged position disengaging the switch;

the latch extending through the side wall opening and having an upper position when the latch is in the engaged position and a lower position when the latch is in the disengaged position, and the latch having a surface engageable by the thumb of the user, the surface sloping downwardly from the side wall having the opening to a distal end of the latch.

2. The power tool of claim 1, wherein the latch is pivotably movable between the engaged and disengaged positions.

3. The power tool of claim 2, wherein the latch is movable between the engaged and disengaged positions by the user's thumb, wherein the thumb engagable surface of the latch travels in an arcuate path when the latch is moved between the engaged and disengaged positions, and wherein the user's thumb travels through an arcuate path that is the same as the arcuate path of the thumb engagable surface of the latch.

4. The power tool of claim 1, wherein each of the side walls has an opening formed therein.

5. The power tool of claim 1, wherein a portion of the latch extends through one of the side wall openings and another portion of said latch extends through the other side wall opening, wherein both portions of the latch that extend through the side wall openings have surfaces which are engageable by the thumb of the user, wherein the latch is movable between the engaged and disengaged positions by downward pressure from the thumb of the user, and wherein the latch may be operated from either side of the housing, thereby making the latch ambidextrous.

6. The power tool of claim 5, wherein the thumb engagable surfaces of the latch travel in arcuate paths when the latch is moved between the engaged and disengaged positions, and wherein the user's thumb travels through an arcuate path that is the same as the arcuate path of the thumb engagable surface of the latch when the latch is moved between the engaged and disengaged positions.

7. A power tool comprising:

a hollow housing defining a handle with an external wall, the handle having an elongated axis generally corresponding to a gripping axis of a user;

a motor in said housing;

a switch mounted in said handle for activating the motor, the switch configured to accommodate an index finger of the user in a trigger fashion;

a support member located adjacent the switch and directly below the index finger of the user during operation such that the index finger of the user can activate the switch and be accommodated by the support member simultaneously, the support member providing a resting surface for the index finger during operation; and a latch located adjacent the switch and mounted in the handle for movement between an engaged position where the latch prevents the switch from activating the motor and a disengaged position where the switch is free to activate the motor.

8. The power tool of claim 7, wherein the support member extends from the external wall of the handle and separates the user's index finger and a middle finger during use.

9. The power tool of claim 8, wherein the switch is pivotally mounted in the handle about a first axis and wherein the latch is pivotally mounted in the handle about a second axis.

10. The power tool of claim 9, wherein the switch has a first locking abutment and the latch has a second locking abutment for engaging the first abutment and preventing the switch from being activated when the latch is in the engaged position.

11. The power tool of claim 10, wherein the switch, when pivoted to engage the first and second abutments, applies a force vector generally intersecting the second axis.

12. The power tool of claim 8, wherein the switch travels in a path when it is activated and wherein the path the switch travels is generally parallel a longitudinal axis of the support member.

13. The power tool of claim 8, wherein the switch travels in a path when it is activated and wherein the path the switch travels is generally parallel a top surface of the support member where the user's index finger rests during use.

14. The power tool of claim 8, wherein the switch travels in a path when it is activated and wherein the path the switch travels is generally parallel a longitudinal axis of the support member.

* * * * *